United States Patent [19]

Krogh

[11] Patent Number: 4,568,086

[45] Date of Patent: Feb. 4, 1986

[54] EDUCATIONAL RANDOM PROBLEM SELECTOR

[76] Inventor: Kris K. Krogh, 6822 Trigo Rd., Goleta, Calif. 93117

[21] Appl. No.: 667,329

[22] Filed: Nov. 1, 1984

Related U.S. Application Data

[63] Continuation-in-part of Ser. No. 420,487, Sep. 20, 1982, abandoned.

[51] Int. Cl.[4] ..... A63B 71/06; A63F 9/00

[52] U.S. Cl. ..... 273/141 R; 434/198; 434/209; 434/322; 273/138 A

[58] Field of Search ..... 273/141 R, 141 A, 142 H, 273/142 HA; 434/198, 199, 201, 202, 206, 209, 322

[56] References Cited

U.S. PATENT DOCUMENTS

| | | | |
|---|---|---|---|
| 1,167,407 | 1/1916 | Johnson | 273/141 R |
| 1,300,315 | 4/1919 | Wilder | 273/249 |
| 1,519,426 | 12/1924 | Walker | 434/198 |
| 1,619,849 | 3/1927 | Brittingham | 273/141 R |
| 1,656,030 | 1/1928 | Waring | 273/142 R X |
| 1,696,987 | 1/1929 | Troidl | 434/199 X |
| 3,141,674 | 7/1964 | Hoffman | 273/142 R |
| 3,206,872 | 9/1965 | Nason et al. | 434/348 |
| 3,233,345 | 2/1966 | Smith | 273/141 R X |
| 3,374,559 | 3/1968 | Smith | 434/322 |
| 3,396,972 | 8/1968 | Smith | 273/141 R X |
| 3,584,398 | 6/1971 | Meyer et al. | 434/201 |
| 3,827,161 | 8/1974 | Nelson | 434/198 |
| 4,040,048 | 8/1977 | Lien | 340/336 |
| 4,247,895 | 1/1981 | Weber | 364/419 |

FOREIGN PATENT DOCUMENTS

| | | | |
|---|---|---|---|
| 609347 | 1/1935 | Fed. Rep. of Germany | 273/142 H |
| 606297 | 6/1926 | France | 434/199 |
| 758251 | 10/1956 | United Kingdom . | |

*Primary Examiner*—Richard C. Pinkham
*Assistant Examiner*—Scott Brown

[57] ABSTRACT

An educational game system wherein a random selector of mathematical problems is used in playing various popular board games, simultaneously providing drill in the multiplication tables. Players must determine missing answer numbers which then dictate game piece movements. Appropriately formulated problem sets, together with dice doubles indicia, permit the random selector device to substitute for dice, spinners, and other random selection means normally used in these games. Changeable problem sets provide drill in particular multiplication tables. Usage procedure facilitates table memorization. The problems each have a missing number in which the majority are not full two digit numbers but the first or second digit of the product or one of the factors. The average value of the missing numbers for a set being less than ten. Five embodiments are disclosed, employing different random selection devices.

20 Claims, 10 Drawing Figures

2× PROBLEM SET

| PROBLEM | MULTI-PLIER | MISSING NUMBER | DOUBLES (*) |
|---|---|---|---|
| 2×3=□ | 3 | 6 | * |
| 2×9=1□ | 9 | 8 | |
| 2×□=14 | 7 | 7 | |
| 2×5=□ | 5 | 10 | |
| 2×6=□ | 6 | 12 | |
| 2×□=6 | 3 | 3 | |
| 2×4=□ | 4 | 8 | * |
| 2×8=1□ | 8 | 6 | |
| 2×□=18 | 9 | 9 | |
| 2×2=□ | 2 | 4 | |
| 2×10=□0 | 10 | 2 | |
| 2×□=10 | 5 | 5 | |
| AVG. MISSING NUMBER = 6.7 | | | |

3× PROBLEM SET

| PROBLEM | MULTI-PLIER | MISSING NUMBER | DOUBLES (*) |
|---|---|---|---|
| 3×8=2□ | 8 | 4 | * |
| 3×6=1□ | 6 | 8 | |
| 3×□=30 | 10 | 10 | |
| 3×7=□1 | 7 | 2 | |
| 3×2=□ | 2 | 6 | |
| 3×9=2□ | 9 | 7 | |
| 3×□=18 | 6 | 6 | * |
| 3×3=□ | 3 | 9 | |
| 3×10=□0 | 10 | 3 | |
| 3×5=1□ | 5 | 5 | |
| 3×□=24 | 8 | 8 | |
| 3×4=□ | 4 | 12 | |
| AVG. MISSING NUMBER = 6.7 | | | |

4× PROBLEM SET

| PROBLEM | MULTI-PLIER | MISSING NUMBER | DOUBLES (*) |
|---|---|---|---|
| 4×5=□0 | 5 | 2 | * |
| 4×□=36 | 9 | 9 | |
| 4×2=□ | 2 | 8 | |
| 4×8=□2 | 8 | 3 | |
| 4×□=20 | 5 | 5 | |
| 4×3=□ | 3 | 12 | |
| 4×9=3□ | 9 | 6 | * |
| 4×□=28 | 7 | 7 | |
| 4×6=2□ | 6 | 4 | |
| 4×4=1□ | 4 | 6 | |
| 4×□=40 | 10 | 10 | |
| 4×7=2□ | 7 | 8 | |
| AVG. MISSING NUMBER = 6.7 | | | |

5× PROBLEM SET

| PROBLEM | MULTI-PLIER | MISSING NUMBER | DOUBLES (*) |
|---|---|---|---|
| 5×4=□0 | 4 | 2 | * |
| 5×7=□5 | 7 | 3 | |
| 5×□=45 | 9 | 9 | |
| 5×3=□ | 3 | 15 | |
| 5×□=40 | 8 | 8 | |
| 5×□=30 | 6 | 6 | |
| 5×2=□ | 2 | 10 | * |
| 5×9=□5 | 9 | 4 | |
| 5×□=35 | 7 | 7 | |
| 5×5=2□ | 5 | 5 | |
| 5×6=□0 | 6 | 3 | |
| 5×□=50 | 10 | 10 | |
| AVG. MISSING NUMBER = 6.8 | | | |

*FIG. 4*

6× PROBLEM SET

| PROBLEM | MULTI-PLIER | MISSING NUMBER | DOUBLES (*) |
|---|---|---|---|
| 6×6=3□ | 6 | 6 | * |
| 6×□=42 | 7 | 7 | |
| 6×4=2□ | 4 | 4 | |
| 6×10=□0 | 10 | 6 | |
| 6×5=□0 | 5 | 3 | |
| 6×□=54 | 9 | 9 | |
| 6×8=4□ | 8 | 8 | * |
| 6×2=□ | 2 | 12 | |
| 6×7=4□ | 7 | 2 | |
| 6×□=60 | 10 | 10 | |
| 6×3=1□ | 3 | 8 | |
| 6×9=□4 | 9 | 5 | |
| AVG. MISSING NUMBER = 6.7 | | | |

7× PROBLEM SET

| PROBLEM | MULTI-PLIER | MISSING NUMBER | DOUBLES (*) |
|---|---|---|---|
| 7×6=□2 | 6 | 4 | * |
| 7×□=70 | 10 | 10 | |
| 7×8=5□ | 8 | 6 | |
| 7×2=□ | 2 | 14 | |
| 7×7=4□ | 7 | 9 | |
| 7×□=56 | 8 | 8 | |
| 7×4=2□ | 4 | 8 | * |
| 7×10=□0 | 10 | 7 | |
| 7×5=3□ | 5 | 5 | |
| 7×□=49 | 7 | 7 | |
| 7×3=□1 | 3 | 2 | |
| 7×9=6□ | 9 | 3 | |
| AVG. MISSING NUMBER = 6.9 | | | |

8× PROBLEM SET

| PROBLEM | MULTI-PLIER | MISSING NUMBER | DOUBLES (*) |
|---|---|---|---|
| 8×3=□4 | 3 | 2 | * |
| 8×7=5□ | 7 | 6 | |
| 8×□=40 | 5 | 5 | |
| 8×2=□ | 2 | 16 | |
| 8×9=□2 | 9 | 7 | |
| 8×6=4□ | 6 | 8 | |
| 8×□=80 | 10 | 10 | * |
| 8×4=□2 | 4 | 3 | |
| 8×10=□0 | 10 | 8 | |
| 8×5=□0 | 5 | 4 | |
| 8×□=72 | 9 | 9 | |
| 8×8=6□ | 8 | 4 | |
| AVG. MISSING NUMBER = 6.8 | | | |

9× PROBLEM SET

| PROBLEM | MULTI-PLIER | MISSING NUMBER | DOUBLES (*) |
|---|---|---|---|
| 9×6=5□ | 6 | 4 | * |
| 9×□=63 | 7 | 7 | |
| 9×4=3□ | 4 | 6 | |
| 9×10=□0 | 10 | 9 | |
| 9×5=4□ | 5 | 5 | |
| 9×□=81 | 9 | 9 | |
| 9×2=1□ | 2 | 8 | * |
| 9×8=7□ | 8 | 2 | |
| 9×7=6□ | 7 | 3 | |
| 9×□=90 | 10 | 10 | |
| 9×3=2□ | 3 | 7 | |
| 9×9=□1 | 9 | 8 | |
| AVG. MISSING NUMBER = 6.5 | | | |

FIG. 5

TIMES TABLES

| | | | |
|---|---|---|---|
| 2×1=2 | 3×1=3 | 4×1=4 | 5×1=5 |
| 2×2=4 | 3×2=6 | 4×2=8 | 5×2=10 |
| 2×3=6 | 3×3=9 | 4×3=12 | 5×3=15 |
| 2×4=8 | 3×4=12 | 4×4=16 | 5×4=20 |
| 2×5=10 | 3×5=15 | 4×5=20 | 5×5=25 |
| 2×6=12 | 3×6=18 | 4×6=24 | 5×6=30 |
| 2×7=14 | 3×7=21 | 4×7=28 | 5×7=35 |
| 2×8=16 | 3×8=24 | 4×8=32 | 5×8=40 |
| 2×9=18 | 3×9=27 | 4×9=36 | 5×9=45 |
| 2×10=20 | 3×10=30 | 4×10=40 | 5×10=50 |

FIG. 6

TIMES TABLES

| | | | |
|---|---|---|---|
| 6×1=6 | 7×1=7 | 8×1=8 | 9×1=9 |
| 6×2=12 | 7×2=14 | 8×2=16 | 9×2=18 |
| 6×3=18 | 7×3=21 | 8×3=24 | 9×3=27 |
| 6×4=24 | 7×4=28 | 8×4=32 | 9×4=36 |
| 6×5=30 | 7×5=35 | 8×5=40 | 9×5=45 |
| 6×6=36 | 7×6=42 | 8×6=48 | 9×6=54 |
| 6×7=42 | 7×7=49 | 8×7=56 | 9×7=63 |
| 6×8=48 | 7×8=56 | 8×8=64 | 9×8=72 |
| 6×9=54 | 7×9=63 | 8×9=72 | 9×9=81 |
| 6×10=60 | 7×10=70 | 8×10=80 | 9×10=90 |

FIG. 7

EDUCATIONAL RANDOM PROBLEM SELECTOR

This application is a continuation-in-part of application Ser. No. 420,487, filed 9/20/82 now abandoned.

CROSS-REFERENCES TO RELATED APPLICATIONS

A related application, directed to a spinner device, will be filed subsequently. This spinner device is also disclosed herein. While the inventions in both applications are capable of independant usage, each includes embodiments which combine features of the other.

BACKGROUND OF THE INVENTION

1. Field of the Invention

The present invention relates to educational game apparatus and its use. In particular, it relates to a unique system which enables children to play a variety of existing popular board games while simultaneously being drilled in basic multiplication. It does this by supplanting the dice, spinners, and other random selection devices normally used in playing these games.

2. Description of the Prior Art

Numerous devices exist for the random selection of arithmetic problems. The most common of these are flash cards. Each of these cards has an arithmetic problem printed on one side, and the answer printed on the opposite side. Flash cards are often used in classrooms, where students are asked to call out answers as they are shown by the teacher. Prior U.S. Pat. Nos. 3,206,872 to Nason et al. and 3,374,559 to Smith disclose flash cards bearing complete multiplication equations, together with movable covering devices which are used to obscure different sections of the equations. This permits different types of problems to be presented using the same cards. U.S. Pat. Nos. 4,040,048 to Lein and 4,247,895 to Weber disclose calculator-type electronic devices which can perform the electronic equivalent of flash card drill.

Prior U.S. Pat. Nos. 1,167,407 to Johnson, 1,300,315 to Wilder and 1,619,849 to Brittingham and Great Britain Pat. No. 758,251 to Peters disclose spinner devices used for the random selection of arithmetic problems. The problems selected by these devices are in the form of a first number, an arithmetic operation, and a second number. For example, twelve divided by two, or seven times five.

U.S. Pat. No. 1,300,315 to Wilder discloses a spinner device which is a random selector of arithmetic problems and also serves as a random number selector which determines how tokens are moved along pathways on an accompanying game board. The spinner device serves this dual function in the following way: The spinner has three concentric bands containing numbers, with the numbers aligned radially so that the spinner's pointer can select one number from each band simultaneously. The numbers in the outermost band are exactly divisible by the numbers in the innermost band, with the quotients, i.e. the numerical outcomes of these division operatioins, ranging from one to ten. In playing the accompanying board game, each turn begins with a player spinning the spinner and computing the quotient from the indicated numbers. The quotient then indicates the number of spaces that a game piece is to be moved on the gameboard's pathways.

This system, wherein the numerical outcome of an arithmetic operation determines the number of spaces moved on a gameboard, works satisfactorily when the operation is division. However, it does not work satisfactorily when the operation is multiplication. The reason is that the numerical outcomes of multiplication problems, i.e. the products, tend to have large and discontinuous values. This is true even when the multiplication is restricted to single digit factors. For example, the product of nine and nine is eighty-one, which would be a very large number of spaces to be counted out on a game board. (Although the spinner device disclosed in U.S. Pat. No. 1,300,315 is also used to present multiplication problems—numbers from the central band are multiplied by numbers from the innermost band—the products, which range from one to one hundred, do not serve to indicate game piece movements. Instead, they are used to determine whether points are to be added to a player's score.)

The problem of large and discontinuous values is solved in the present invention. The present invention includes a random selector device with which multiplication problems are posed and answered in a novel fashion, and wherein the answers have a range of values which is useful for playing a variety of existins board games. Additional advantages of the present invention over the prior art will become apparent below.

SUMMARY OF THE INVENTION

The multiplicaton tables are among the most basic and important facts taught in primary schools. However, many students lack the motivation to memorize them completely. To make memorizing the tables more engaging, one object of the present invention is to provide a system whereby students can play popular board games and perform multiplication drill simultaneously. A further object is that it be capable of providing drill in all multiplicative combinations of the numbers two through nine, from two times two to nine times nine. A still further object is that it be capable of providing drill in equations which start with a particular multiplicand exclusively. For example, for students learning the five times equations, it could provide drill in just these equations.

The present invention includes a random selector device which selects multiplication problems. These problems are divided into sets, and the random selector operates on one set at a time, with the problems in particular sets beginning with the same multiplicand. Rather than presenting multiplication problems in the usual way, as operations to be performed, in the present invention they are presented as equations having numbers missing from various points in the equations. The missing number may be either the entire product, the first digit of a two digit product, the second digit of a two digit product, or the multiplier. (The terms for the parts of a multiplication equation are: multiplicand times multiplier equals product.) By employing these various formats, the missing answer numbers for each problem set are tailored to a desirable range of values. In playing board games, these missing answer numbers are first determined and then serve to indicate the number of spaces that game pieces are moved in board games. For verifying the answer numbers, answer cards showing the complete multiplication equations are provided.

The present invention includes features which permit it to substitute for several types of random selector devices used in playing board games. To permit it to substitute for a pair of dice, the missing answer numbers within each problem set include all the numbers from two through ten and usually include some higher number, and have an average value varying from 6.5 to 6.9, depending on the problem set. This is close to the number range and average number value for dice rolling. (The numbers generated by rolling dice range from two through twelve and have an average value of seven.) Some games which normally incorporate dice require the player to roll doubles in certain circumstances. For example in Monopoly, U.S. Pat. No. 2,026,082 to Darrow, it is necessary to roll doubles to "get out of jail free". Doubles occur, on the average, once for every six dice rolls. To provide a doubles feature, one sixth of the problems in each problem set are accompanied by indicia which designate them as representing doubles.

By functioning as a random number selector the present invention can also substitute for the spinners used in playing many board games, for example in Chutes and Ladders, a game manufactured by the Milton Bradley Co. of Springfield Mass. In addition, the present invention can replace a spin wheel used in playing the game of Life, also made by Milton Bradley.

The present invention also includes a usage procedure which provides improved multiplication drill. The procedure for playing the educational game described in U.S. Pat. No. 1,300,315 to Wilder, noted in the prior art, is to begin each turn by spinning the spinner to randomly select a problem, figuring the answer number, and moving a game token that many spaces on the game board. This procedure might have limited value if used with the present invention. The reason is that, with the missing number problem formats used, it would be possible for players to answer many problems by memorizing single digit answer numbers, without learning the complete multiplication equations. However, this limitation is overcome by the usage procedure included in the present invention, which provides drill in the complete equations.

This invention provides, for the first time, a means of accomodating systematic multiplication drill to the playing of existing popular popular board games.

BRIEF DESCRIPTION OF THE DRAWINGS

FIGS. 4 and 5 are tables showing multiplication problem sets used with the present invention. The multiplier and missing number for each problem is shown in addition to the problem itself. Also, asterisks are used to denote problems which are accompanied by special indicia which represent dice doubles.

FIGS. 6 and 7 show the two sides of an answer card.

DESCRIPTION OF THE PREFERRED EMBODIMENTS

Figure 3:
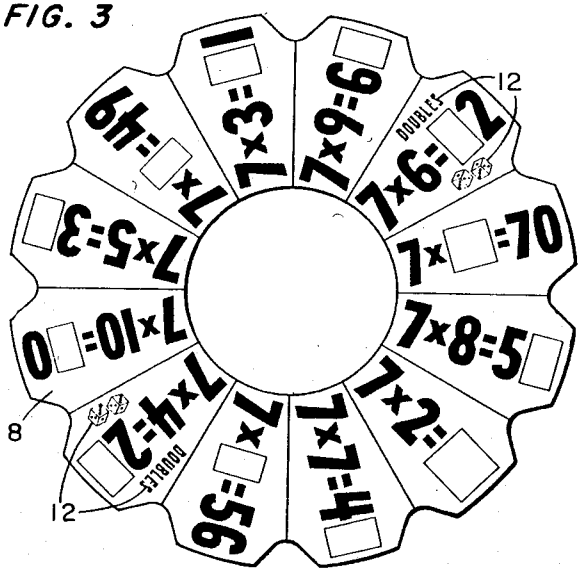
FIG. 3 shows the reverse side of the problem disk which appears in FIG.1.

Five preferred embodiments will be discussed. The first of these is based on a single spinner device. The remaining embodiments include other devices which substitute for the spinner device of the first embodiment. Each of these embodiments performs the same function in basically the same way.

The first embodiment, shown in FIGS. 1 through 7 includes a spinner device, a set of four problem disks, and four answer cards. The spinner device, FIGS. 1 and 2, has three main parts: a base 1, upper section 2, and rotatable pointer 3, and is constructed primarily of molded plastic. (Cardboard, paper, or wood could also be used.) The upper section has a central member 4, which protrudes through a hole in the center of the base 1. This member serves two functions. First, it serves as a seat for the metal (or plastic) pin 5, which secures the rotatable pointer. Second, it serves as a pivot, permitting the upper section 2 to be rotated with respect to the base 1, like a lazy Susan. A circular push-on metal fastener 6 (or some other fastening device) is attached to the lower end of the central member to prevent the upper and lower sections from separating when the spinner device is picked up.

The reason the spinner device is constructed with a turnable upper section 2 is that the rotatable pointer 3, which is spun with a finger, may select indicia which are oriented the wrong way for proper viewing by a user. The upper section, which carries the indicia, can then be turned around so that the selected indicia are right-side-up and easier to read. Finger notches 7 are provided in the upper section to facilitate turning it. Because the rotatable pointer is frictionally engaged to the upper section when it stops spinning, it can turn together with the upper section and can continue to point to the same indicia. The base 1 is equipped with rubber foot pads 10 to help prevent skidding when the upper section is being turned.

Indicia for the spinner device are printed on the four problem disks, which are made of cardboard or some other flat material. One of the problem disks 8 is shown mounted on the spinner mechanism in FIGS. 1 and 2. The problem disks are interchangeable and are mounted one at a time. Each has a large central hole which permits placing disks on the spinner device and removing them without removing the pointer from the spinner device. The problem disks also have twelve equally spaced notches cut in their outer edges, which serve a dual purpose. First, three of these notches mate with three raised tabs 11 located on the upper section of the spinner device. These mating tabs and notches hold the problem disks in place on the spinner device. Second, the remaining nine notches in the problem disks coincide with the finger notches in the upper section of the spinner device, permitting access to them.

The problem disks are divided into twelve equal sections by printed radial lines and a multiplication problem is printed inside each section. The problems are printed in various colors, with each problem a different color than the problems adjacent to it. This helps each problem stand out visually from its neighbors, and helps prevent confusion when a user is trying to read a particular problem. The problem disks are printed on both sides, and problem sets are changed simply by turning a problem disk over or replacing it with another. FIG. 3 shows the opposite side of the problem disk in shown in FIG. 1. With four problem disks and two problem sets per disk, there are eight problem sets in all. These problem sets are shown schematically in the tables in FIGS. 4 and 5, together with information about each set. Many variations of these problem sets would also be feasible. However, these particular problem sets have certain desirable characteristics which will be discussed here.

Figure 1:
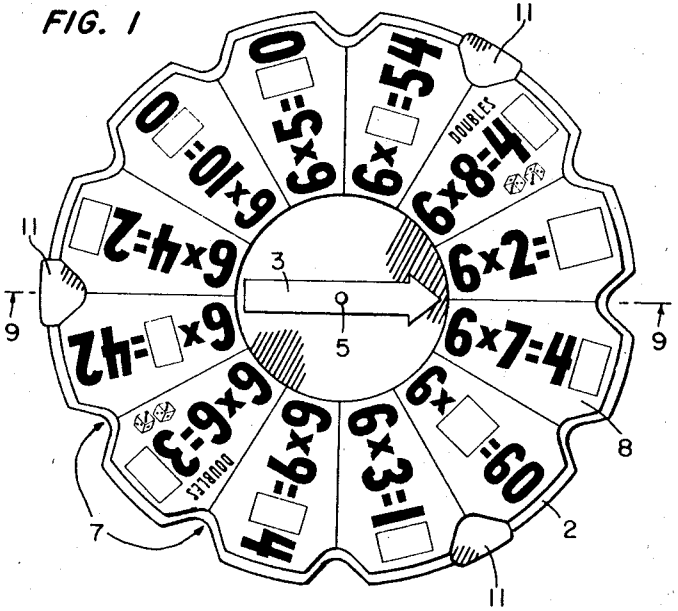
FIG. 1 is a top view of a spinner device with a problem disk mounted on it.
Figure 2:
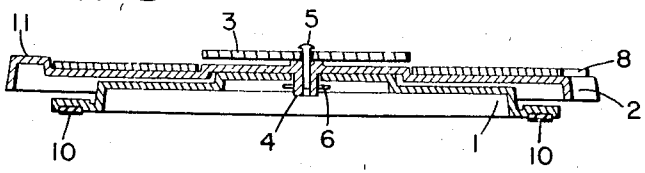
FIG. 2 is a vertical cross-sectional view taken along lines 9—9 of FIG. 1.

Each problem in a particular problem set begins with the same multiplicand, for example, the set shown on the problem disk in FIG. 1 consists entirely of "6×" equations. The reason each problem set deals with a particular multiplicand is that this is generally the way the multiplication equations are taught in schools—one multiplicand at a time. The use of single multiplicands also offers other advantages in terms of usage which will be described below where usage is discussed. The eight problem sets shown in FIGS. 4 and 5 include all the single digit multiplicands from 2× through 9×. The multiplicand 1× is omitted because most students need little help in multiplying the number one, and multiplicands of more than one digit are omitted because the equations for these can be obtained from the single digit equations.

Each multiplication problem consists of an equation with a number missing, as shown in the tables of FIGS. 4 and 5. A missing number is represented by an empty box, with a narrow box representing a single digit missing number and wider boxes representing two digit missing numbers. Alternatively, the missing numbers can be represented by single and double blank spaces which are underlined, or by some other symbol.

A missing number in these multiplication equations is either the entire product, the first digit of a two digit product, the second digit of a two digit product, or the multiplier. (The terms for the parts of a multiplication equation are: multiplicand times multiplier equals product.) All of these formats are used in each problem set; the reason for this is that they are needed to meet several conditions. One of these conditions is that the missing answer numbers should approximate those that would be obtained from rolling a pair of dice, to permit the present invention to substitute for dice in playing board games. Another condition is that each problem set should contain certain equations, specifically, equations for all the multipliers from ×2 through ×9, to provide comprehensive drill in the basic multiplication equations. A third condition is that the problem formats used should resemble that of ordinary multiplication problems as closely as possible.

The numbers obtained from rolling dice range from two through twelve and have an average value of seven. As shown in FIGS. 4 and 5, the missing numbers for each set include all the numbers from two through ten, and usually some higher number, and have an average value ranging from 6.5 for the 9× problem set to 6.9 for the 7× problem set. A typical problem set, the 6× set shown in FIG. 1, illustrates how these missing number values are obtained. If these problems were of the usual type, where six times some number equals a missing number, the missing number values would be multiples of six, ranging from twelve through fifty-four. Of course these values do not fit an appropriate range for use with board games such as those that use a pair of dice. To obtain a missing number value of two, the expression 6×7=4_is used. To obtain a value of three, 6×5=_0 is used. For a value of four, 6×4=2_is used, and so on. By using missing numbers taken from various points in the equations, missing numbers including all the numbers from two through ten are obtained, and in the case of the 6× problem set, also the number twelve.

Where possible, the missing numbers are taken from the product—either the first or second digits of a two digit product, or the entire product, since these formats are closest to the way in which multiplication problems are usually presented. However, in each problem set there are certain needed missing numbers that do not appear in any of the products. In the case of the 6× problem set; the numbers seven and nine do not appear in any of the products. To obtain these missing number values, equations with missing multipliers are used. For example, the equation 6×_=42 gives a missing number of seven.

In order to more closely approximate the range of values produced by rolling dice, equations with a multiplier of ten are introduced into each set. In problem sets where the number ten does not appear as a product, equations with a missing multiplier of ten are used to provide this missing number value. For example, 6×_=60. Equations with missing multipliers of eleven and twelve could also be used to duplicate the range of values produced by dice even more completely. However, multiplication by eleven and twelve would produce problems which would be very demanding for students who are just learning to multiply.

As shown in FIGS. 4 and 5, each problem set contains twelve problems. Only nine would be needed to provide drill in all the multipliers from ×2 through ×10, and only ten problems would be needed to provide missing numbers of from two through ten plus some higher number. However, more problems are needed to meet both these conditions simultaneously, while using mainly problems with missing numbers in the products. This is due to scarcities and overabundances of certain numbers in the products in each set. The additional problems also provide some lattitude for adjusting the average value of the missing numbers in each set.

With twelve problems in each set, three equations are used twice, with different missing digits. For example, in the 6× problem set the equation 6×7=42 is used twice—once as 6×7=4_, to produce a missing number value of two, and again as 6×_=42, to produce a missing number value of seven. Since certain equations are used twice in a given set, more drill is provided in these equations. To provide more proportionate amounts of drill in the multiplication of particular pairs of numbers, the double usage of any equation within a given set is taken into account when formulating problems for the other sets. For example, since the equation 6×7=42 is used twice in the 6× problem set, care is taken not to use the equation 7×6=42 twice in the 7× problem set. In the problem sets shown in FIGS. 4 and 5, no pair of factors is used twice in more than one problem set.

As shown in FIGS. 4 and 5, two or three missing numbers are produced twice in each problem set. For example, in the 6× set, 6×3=$1_{13}$ and 6×8=4_both give the missing number eight. However, no missing number appears more than twice in any problem set. Those missing numbers that do appear twice are chosen taking the average missing number values for the sets into account. For example, using the missing number two twice would lower the average value of a set, and using the missing number ten twice would raise it. Again, the average value for dice rolling is seven and the average missing number values for the problem sets in FIGS. 4 and 5 range from 6.5 for the 9× problem set to 6.9 for the 7× problem set.

Two of the twelve problems in each set, one sixth of them, are designated as representing doubles for dice simulation purposes. As shown in FIG. 3, this is done by including additional indicia 12, in two of the problem containing sections of a problem disk. The indicia consist of a picture of a pair of dice and the word "DOUBLES". Alternatively, other indicia designated as representing doubles could be used instead. In the problem sets shown in FIGS. 4 and 5, asterisks denote those problems which have been chosen to represent doubles. For game playing purposes, the missing numbers from these problems can serve the same function as rolling doubles with dice. Both for the case of real dice and in the present invention, the doubles condition comes up at random, in one out of six usages on the average. This represents another advantage of using sets consisting of twelve problems, since twelve is exactly divisible by six.

In addition to problem sets such as those shown in FIGS. 4 and 5, it would be possible to employ different types of problem sets. The following variations could also be used: sets where the number of problems is not twelve, sets with a somewhat different range of missing numbers, sets with more than one multiplicand in them, and sets where most of the missing numbers are multipliers rather than missing numbers in the products.

Two sides of an answer card are shown in FIGS. 6 and 7. There are four identical such cards that accompany the spinner device and problem disks. The answer cards are made of cardboard or some other flat material and have multiplication tables printed on both sides. As shown in FIGS. 6 and 7, the equations in each multiplication table are arranged in vertical columns with four tables arranged side by side on each side of a card. The 2×, 3×, 4×, and 5× equations are printed on one side, and the 6×, 7×, 8×, and 9× equations appear on the opposite side. For comprehensiveness, each table shows all the multipliers from ×1 through ×10, although ×1 problems are not included in the problem sets.

The multiplication tables on the answer cards are printed in different colors, or in some other fashion such that each table stands out visually from the others. This helps a user refer to a particular table more quickly and with less confusion. As shown in FIGS. 6 and 7, one side of an answer card has white (blank) margins, while the margins on the opposite side are dark (black). Differently colored margins enable a player to determine immediately whether he is looking at the correct side of his answer card.

The procedure for using this embodiment is as follows: To start, a board game is set up, a problem set is mounted on the spinner, and an answer card is given to each player. The spinner's pointer is spun, and the person it points closest to goes first. Then, during each turn of the game, the player whose turn it is spins the pointer and must determine the missing number for the problem indicated. This number then tells how many spaces he moves a piece on the game board. To determine the missing number, the player first recites the complete multiplication equation, or his best guess, without looking at his answer card. The other players check their answer cards and tell whether he was right or wrong. If wrong, the player must then read the complete equation aloud from his answer card. Next, he tells what the missing number was and moves a game piece that many spaces. This procedure helps ensure that the players will learn complete multiplication equations, instead of memorizing only single digit answer numbers. It also gives every player an active role to play during each turn of any game played, and can add interest to games in addition to increasing their educational value.

Problem sets can be changed in the course of a game without affecting play. In playing long board games, if the players master one problem set, they can elect to go on to another. Although each problem set provides drill in only a single multiplicand, drill can be provided in any desired combination of multiplicands by changing sets. In classroom usage, teachers can tell their students when and which problem sets to change to, to provide desired amounts of drill in different areas.

Because all of the problems in each problem set begin with the same multiplicand, all of the corresponding complete equations for a particular problem set are found in a single multiplication table on the answer cards, which simplifies looking up answers. If the problems in each set began with various multiplicands, the search for answers could slow the progress of board games. Another advantage to having all of the problems in each set begin with a single multiplicand is that it makes it practical for players to prepare their own answer cards. For additional multiplication practice when the present invention is used in the classroom, a teacher can have her students write the multiplication table for a given multiplicand on paper or four by six inch file cards. These tables can then be used in place of the regular answer cards with the corresponding problem set. If the multiplicands in a particular problem set were mixed, preparing answer cards for it would present students with a more complex assignment.

The present invention can be used with a wide variety of board games suitable for children of all ages. Chutes and Ladders, made by the Milton Bradley Co. of Springfield Mass. is recommended by the manufacturer for children ages four to ten. Chutes and Ladders normally uses a spinner which selects numbers ranging from one to six to determine the movement of game pieces. When the present invention is substituted for this spinner, a larger number range is obtained; however, this larger number range does not alter the nature of the game greatly and the present invention can be used quite satisfactorily with this game. Bonkers, made by Parker Bros. of Beverly Mass., is recommended for children ages eight to adult. Bonkers normally uses a pair of dice to determine game piece movements. As described, the present invention is designed to substitute for a pair of dice and is well suited for playing this game.

Life, made by Milton Bradley, and Monopoly, U.S. Pat. No. 2,026,082 to Darrow, are examples of longer games which are suitable for remedial multiplication drill with intermediate or high-school-aged students. Life normally employs a spin wheel to provide random numbers ranging from one to ten, which is close to the range of numbers provided by the present invention, while Monopoly normally uses a pair of dice. Since these games are enjoyed by adults as well as children, homework assignments can be given where students are asked to play these games with their parents or other adults, using the present invention. And, since these games are long, often over an hour long, extensive drill can be provided in a variety of multiplicands in a single game.

The second embodiment of the present invention employs a spin wheel (also known as a "wheel of fortune") in place of the spinner device of the first embodiment. In this embodiment, problem disks are mounted on a spin wheel and problems are selected by spinning the wheel and waiting until it stops, at which time a problem is indicated by a fixed clicker element. U.S. Pat. No. 3,141,674 to Hoffman discloses a "spin wheel game having interchangable faces" which could be used for this purpose, with one modification. This modification would be to reduce the number of stopping positions on the wheel from sixteen to twelve, to accommodate sets of twelve problems with a problem at each stopping position. Since this device has no moving pointer to point to which player is to go first in a game, this can be determined by having each player spin the wheel and find the missing number for the problem indicated, and having the player with the highest number go first. Aside from this exception, this embodiment is used in the same manner as the first.

Figure 10:
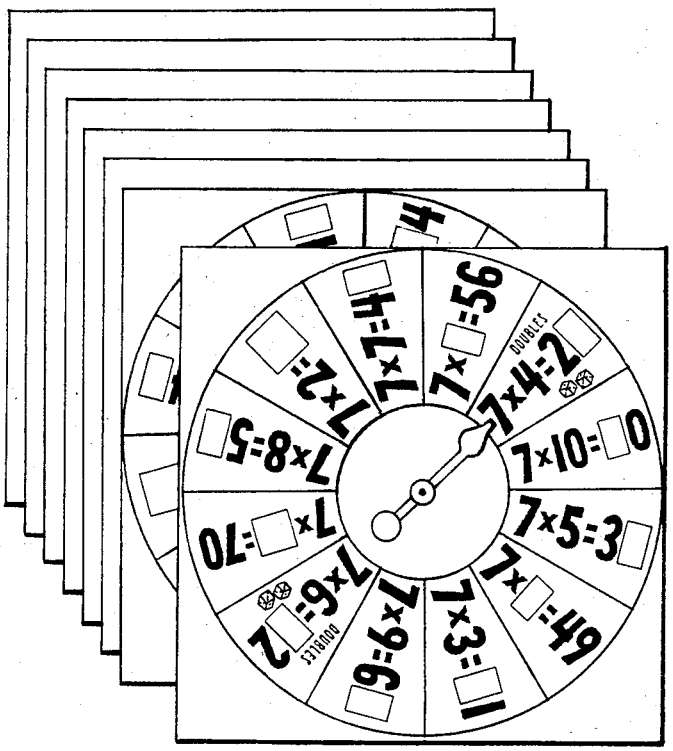
FIG. 10 is a perspective view showing eight separate spinner devices employed in another embodiment of the present invention.

The third embodiment of the present invention employs a group of spinner devices in place of the single spinner device of the first embodiment. In this embodiment, a separate inexpensive spinner is used for each problem set. These spinners are constructed in some commonplace fashion, such as plastic pointers riveted to cardboard cards, and can be manufactured readily by existing facilities. However, these spinners are not as convenient to use as that described in the first embodiment. Eight separate spinners implementing this embodiment are shown in FIG. 10.

Figure 8:
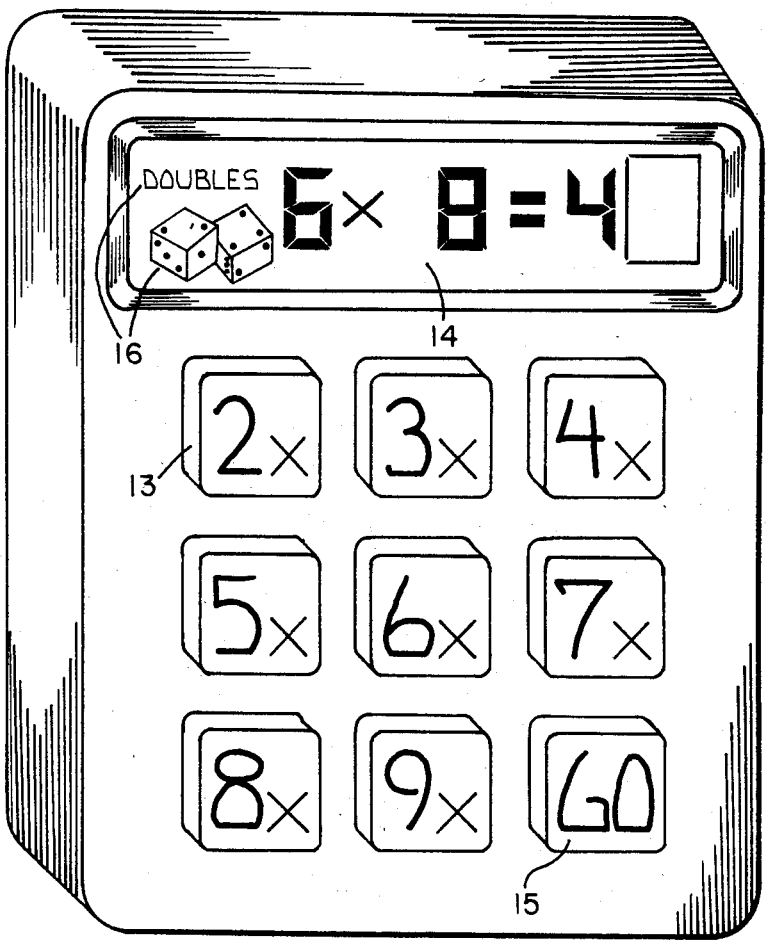
FIG. 8 is a perspective view of a calculator-type electronic device used in an alternate embodiment of the present invention.

A fourth embodiment of the present invention, shown in FIG. 8, includes a calculator-type electronic device as the random problem selector in place of the spinner used in the first embodiment. The problem sets used in the preceeding embodiments and shown in FIGS. 4 and 5 can also be used with this embodiment. In this embodiment the problem sets are stored in electronic memory and sets are selected by pressing an appropriately labelled button. For example, the "2×" button 13 would select the two times equations. Problems are presented by means of a liquid crystal display 14. (Alternatively, an LED display or some other type of electronic display could be used.) The presentation of problems is actuated by the "GO" button 15. When the "GO" button is pressed, the device selects a problem at random from the chosen problem set, by electronic means, and presents it on the display 14. A given problem remains visible on the display until the "GO" button is pressed again.

The format with which problems are presented on the display can be the same as that used for individual problems in the preceeding embodiments, and pressing the "GO" button performs the same function that spinning the pointer does in the first embodiment. To provide the dice doubles feature, extra indicia 16 are included in the display 14. These indicia are evoked electronically and appear at random in one sixth of the problem presentations on the average, as in the preceeding embodiments. Since there is no pointer to indicate which player is to go first in a board game, the player with the highest missing number goes first, as described in the second embodiment. To simplify the description of this embodiment, only the most essential features have been described. However, it would be possible to combine the features of this embodiment with those of existing calculator-type electronic teaching aids to provide a device with additional educational capacities.

Figure 9:
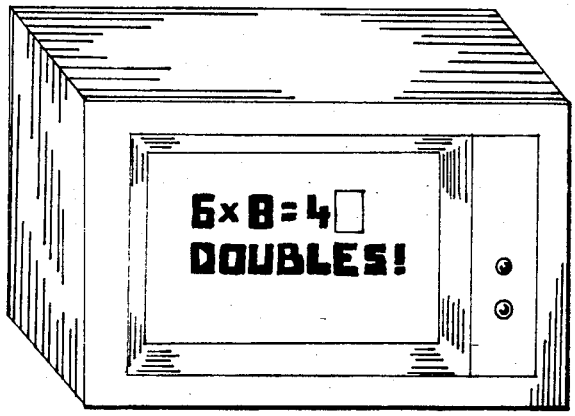
FIG. 9 is a perspective view of a CRT display presenting a randomly selected problem in a computer embodiment of the present invention.

The fifth embodiment of the present invention is similar to the fourth; however, it uses a standard computer terminal with a typewriter-type keyboard and a CRT (television) display rather than a calculator-type device. An example of a suitable computer terminal is the Apple computer, manufactured by Apple Computer Inc. of Cupertino Ca. As in the fourth embodiment, problem sets such as those in FIGS. 4 and 5 are stored in electronic memory, problem sets are selected and individual problems are randomly presented by pressing buttons, and problems as well as indicia indicating dice doubles are presented by means of an electronic display device. In this embodiment, the electronic display device is the terminal's CRT, and the buttons used are the keys of the terminal's keyboard. FIG. 9 illustrates a computer generated CRT display.

Computer terminals such as the Apple are equipped to display a wide range of graphics (visual patterns) on their CRTs. This capability makes it possible for such computers to display missing number problems with boxes surrounding the missing numbers, as well as dice doubles indicia, through 15 appropriate programming. Of course a standard computer keyboard lacks specially labelled buttons such as "2×" and "GO", found in the fourth embodiment; however, the computer can be programmed such that the keys for the numbers two through nine can take the place of the "2×" through "9×" buttons, and the "RETURN" key found on standard keyboards can take the place of "GO". The CRT graphics, keyboard functions, problem randomization, and all other functions needed to implement the present invention on a standard computer terminal can all be provided through existing programming methods. Usage instructions can also be stored in computer memory and displayed on the CRT upon command.

Although particular embodiments of the present invention have been disclosed for illustrative purposes, various changes could be made in its structure and use. The present invention should not be considered limited by these particular embodiments, but rather by the spirit and scope of the claims below.

What is claimed is:

1. A random selector of multiplication problems comprising:

(a) means to select one of a plurality of presented multiplcation problems;

(b) the multiplication problems including some multiplicative combinations of the numbers two through nine;

(c) each multiplication problem having a missing number where the majority of the missing numbers are not full two digit products and where some of the missing numbers are first digits of two digit products, some are second digits of two digit products, some are a factor, and others are full products;

(d) the missing numbers are clearly indicated by symbols;

(e) the multiplication problems are divided into sets; and, (f) the average value of the missing numbers in each set is less than ten.

2. A random problem selector according to claim 1, where the majority of the missing numbers are numbers in the products.

3. A random problem selector according to claim 1, where the missing numbers in each problem set include all the numbers from two through ten.

4. A random problem selector according to claim 1, wherein all of the problems within particular sets have the same multiplicand.

5. A random problem selector according to claim 1, where the number of problems in each set is twelve.

6. A random problem selector according to claim 1, wherein one sixth of the problems in each set are accompanied by indicia which denote doubles for dice simulation purposes.

7. A random problem selector according to claim 1, where the random problem selection means is a spinner device having changeable indicia.

8. A random problem selector according to claim 7, where the indicia are printed on sheets of a flat material, with a problem set printed on each side of a sheet.

9. A random problem selector according to claim 1, where the random problem selection means comprises a group of spinner devices, with a separate spinner device for each problem set.

10. A random problem selector according to claim 1, where the random problem selection means is a spin wheel device.

11. A random problem selector according to claim 1, where the random problem problem selection means is an electronic device.

12. A random problem selector according to claim 11, where the random problem selection means is a computer terminal.

13. A random selector of mathematical problems comprising:

(a) means to select one of a plurality of presented mathematical problems;

(b) each mathematical problem having a missing number;

(c) the missing numbers are clearly indicated by symbols;

(d) the mathematical problems are divided into sets;

(e) the average value of the missing numbers in each set is less than ten;

(f) approximately one sixth of the problems in each set are accompanied by indicia which denote doubles for dice simulation purposes.

14. A random problem selector according to claim 13, where the number of problems in each set is twelve.

15. A random problem selector according to claim 13, where the random problem selection means is a spinner device having changeable indicia.

16. A random problem selector according to claim 15, where the indicia are printed on sheets of a flat material, with a problem set printed on each side of a sheet.

17. A random problem selector according to claim 13, where the random problem selection means comprises a group of spinner devices, with a separate spinner device for each problem set.

18. A random problem selector according to claim 13, where the random problem selection means is a spin wheel device.

19. A random problem selector according to claim 13, where the random problem problem selection means is an electronic device.

20. A random problem selector according to claim 19, where the random problem selection means is a computer terminal.

* * * * *